US006874958B1

(12) United States Patent
Panebianco et al.

(10) Patent No.: US 6,874,958 B1
(45) Date of Patent: Apr. 5, 2005

(54) PORTABLE PRINTER WITH SPINDLE MEMBERS FOR ROTATIONALLY MOUNTING MEDIA ROLLS OF DIFFERENT CORE DIAMETERS

(75) Inventors: Gregory P. Panebianco, Warwick, RI (US); David F. Beck, Exeter, RI (US); Gregory J. Klein, Newport, RI (US)

(73) Assignee: ZIH Corp., Hamilton (BM)

( * ) Notice: Subject to any disclaimer, the term of this patent is extended or adjusted under 35 U.S.C. 154(b) by 0 days.

(21) Appl. No.: 10/783,102

(22) Filed: Feb. 20, 2004

(51) Int. Cl.[7] ..... B65H 75/00

(52) U.S. Cl. ..... 400/243; 400/242; 242/358.1; 242/597.4

(58) Field of Search ..... 400/242, 243, 400/246; 242/570, 571, 571.1, 594.1, 597.4, 358.1; 226/184

(56) References Cited

U.S. PATENT DOCUMENTS

| | | | | | |
|---|---|---|---|---|---|
| 2,238,191 | A | * | 4/1941 | Shelton | 242/358.1 |
| 3,580,524 | A | * | 5/1971 | Weaver | 242/129.7 |
| 4,440,357 | A | * | 4/1984 | Vaughan | 242/599.4 |
| 4,534,499 | A | * | 8/1985 | Cox et al. | 226/184 |
| 4,821,974 | A | | 4/1989 | Poehlein | |
| 5,100,250 | A | * | 3/1992 | Suzuki et al. | 400/208 |
| 5,228,633 | A | | 7/1993 | Johnson et al. | |
| 5,267,800 | A | | 12/1993 | Petteruti et al. | |
| 5,396,313 | A | * | 3/1995 | Zoltner et al. | 399/23 |
| 5,447,379 | A | | 9/1995 | Pou | |
| 5,813,343 | A | | 9/1998 | Harb | |
| 5,860,753 | A | | 1/1999 | Beck et al. | |
| 5,997,195 | A | * | 12/1999 | Burgin | 400/242 |
| 6,422,770 | B1 | * | 7/2002 | de la Reguera | 400/208 |
| 6,481,995 | B2 | | 11/2002 | Delrosario et al. | |
| 6,491,252 | B2 | | 12/2002 | Komatsu et al. | |
| 6,536,696 | B2 | | 3/2003 | Fiutak et al. | |
| 6,607,316 | B1 | | 8/2003 | Petteruti et al. | |
| 6,609,844 | B1 | | 8/2003 | Petteruti et al. | |
| 6,796,234 | B1 | * | 9/2004 | Busshoff | 101/389.1 |
| 2003/0141655 | A1 | | 7/2003 | Bryer | |

* cited by examiner

*Primary Examiner*—Andrew H. Hirshfeld
*Assistant Examiner*—Dave A. Ghatt
(74) *Attorney, Agent, or Firm*—Alston & Bird LLP

(57) ABSTRACT

A portable printer is provided having a housing with a compartment for a roll of media and two spindle members coupled to roll positioning mechanism in the compartment. Each spindle member has tow sides with different diameter conical surfaces and is reversibly mountable in the printer to select such conical surface having a diameter for engaging the core diameter of a roll mounted between the spindle members. Each of the spindle members is reversible in the printer to enable presentation of two different diameter conical surfaces for engaging two different diameter roll cores in the printer. The conical surfaces can also reshape the ends of a crushed roll core from a oval to a circular cross-sectional shape when the spindle members are urged towards each other by the roll positioning mechanism into the ends of the roll core, thereby providing for proper rotational mounting of such roll in the printer.

23 Claims, 3 Drawing Sheets

PORTABLE PRINTER WITH SPINDLE MEMBERS FOR ROTATIONALLY MOUNTING MEDIA ROLLS OF DIFFERENT CORE DIAMETERS

FIELD OF THE INVENTION

The present invention relates to portable printers which print on media from a roll, and relates particularly to rotationally mounting of media rolls of different core sizes in a portable printer between a pair of reversible spindle members, where each spindle member has two sides each with features for engaging roll cores of different diameters.

BACKGROUND OF THE INVENTION

Conventional portable printers use a roll of wound media, such as paper or label stock, which is loaded into the printer such that the media from the roll will properly feed and align with a thermal print head for printing. These rolls have tubular cores and portable printers typically have a pair of holder members each with an extending cylindrical shaped surface for engaging into a roll core, thereby limiting mounting of such rolls with cores of a inner diameter which can frictionally engage the outer diameter of the cylindrical shaped surface. Often such holder members are part of a roll positioning mechanism with respect to printing elements of the printer. One example of such a portable printer is shown in U.S. Pat. No. 6,609,844, which has a rack and pinion gear centering mechanism having two rotational spindle members for mounting a roll.

Often rolls are crushed during transportation or storage and will lack a circular cross-sectional shape for proper rotational mounting when loaded in the portable printer, resulting in misaligned rolls which can negatively effects printer performance. This is due to such crushed rolls having a non-circular (oval or eye shape) cross-sectional shaped core, rather than the needed circular cross-sectional shape for mounting on holders or spindle members. Although a user can attempt to recrush the roll in another dimension to re-circularize the roll, the roll is prone to damage and may still not properly rotationally mount in the printer. Thus, holders or spindle members for mounting rolls are desirable which can be used for different diameter rolls and can automatically reshape (or re-circularize) the ends of core crushed rolls.

Different mechanisms have been developed for supporting a roll of media between two members via insertion into the ends of a roll's tubular core. U.S. Pat. No. 5,813,343 describes a roll mounting mechanism with two holders each having a cylindrical head with axially spaced concentric steps to accommodate the inner diameters of different dimension tubular cores, such holders are spring urged towards each other. The front of each concentric step extends to a truncated conical form. U.S. Pat. No. 6,536,696 describes a point of sale printer having pair of spherical bearing members each extending into the ends of a central core of a roll. U.S. Pat. No. 4,821,974 describes a large document printer having two spindles shafts each with a conical surface and a hub assembly having compression springs for urging the each shaft's conical surface into the ends of a media roll core. None of these patents provide spindle members for rotationally mounting a roll which are reversibly mountable in the printer to accommodate different diameter core rolls and have surfaces capable of automatically re-circularizing the ends of a crushed roll core when such holder or spindle members are urged together into the roll core.

SUMMARY OF THE INVENTION

It is an object of the present invention to provide a portable printer for rotationally mounting media rolls of different core sizes between a pair of spindle members which are reversibly mountable in the printer to accommodate different diameter core rolls in the printer.

It is another object of the present invention to provide rotationally mounting of media rolls between a pair of spindle members each having a surface capable of automatically re-circularizing the ends of a crushed roll core when the spindle members are urged together.

Briefly described, a portable printer is provided having a housing with a compartment for a roll of media having a core, a roll positioning mechanism, and two spindle members coupled to the roll positioning mechanism to face each other in the compartment. Each of the spindle members has two sides with different diameter conical surfaces and is reversibly mountable to the roll positioning mechanism to select the side of each of the spindle members having the conical surfaces of a diameter for engaging the diameter of the core of the roll mountable between the spindle members.

The spindle members can be detached, reversed, and reattached in the printer, thereby enabling presentation of two different diameter conical surfaces for engaging two different diameter roll cores in the printer. The conical surfaces can also reshape the ends of a crushed roll core from a oval cross-sectional to a substantially circularly cross-sectional shape when the spindle members are urged towards each other by the roll positioning mechanism (with or without manual assistance) into the ends of the roll core, thereby providing for proper rotational mounting of such roll in the printer. Thus, the present invention can compensate for rolls with oval cores if loaded in the portable printer.

In a preferred embodiment, the portable printer has a housing with a compartment for a roll of media, a centering mechanism having two edge guide members movable in opposite directions with respect to a position between the edge guide members, two spindle members each rotatably mountable upon a different one of the edge guide members for engaging the ends of a tubular core of a roll when loaded in the printer's compartment, thereby aligning media from the roll for printing and advancement in the printer. Each spindle member represents a disk shaped element with two sides, each side having a truncated conical surface of a different diameter extending from the disk element, where the diameter of the conical surface decreases away from the disk element, and an opening extending through the sides of the disk member centrally disposed with respect to the conical surface of each side to provide a hub for enabling rotational mounting of the spindle member upon a shaft extending from its respective edge guide member. Each of the spindle members are detachable and attachable to its respective edge guide member such that the side of each spindle member facing the roll is selected to have the conical surface of a diameter for engagement into a core of a roll when loaded in the printer's compartment.

The present invention also provides a method for using the spindle members in a printer having the steps of providing two roll supporting members rotationally mountable in the printer, in which each of the members has two sides, each side has features for engaging rolls of different diameter cores than the other side of the member; and rotationally mounting each member in the printer in which the side of each member facing the roll has the features for engaging the interior diameter of the core of the roll.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF THE INVENTION

Figure 1:
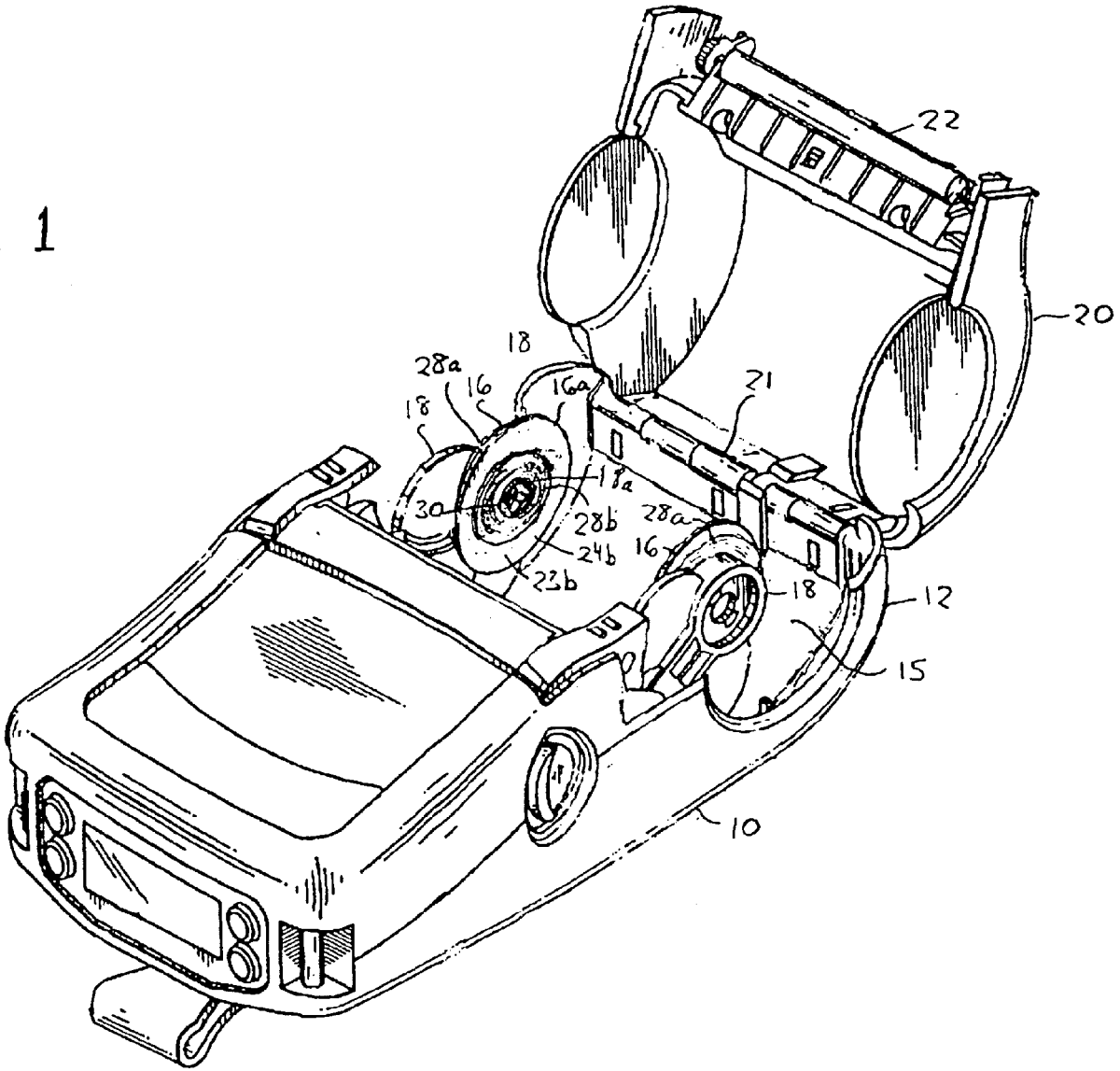
FIG. 1 is a perspective view of a portable printer having a pair of spindle members for rotationally mounting a media roll in accordance with the present invention.
Figure 1A:
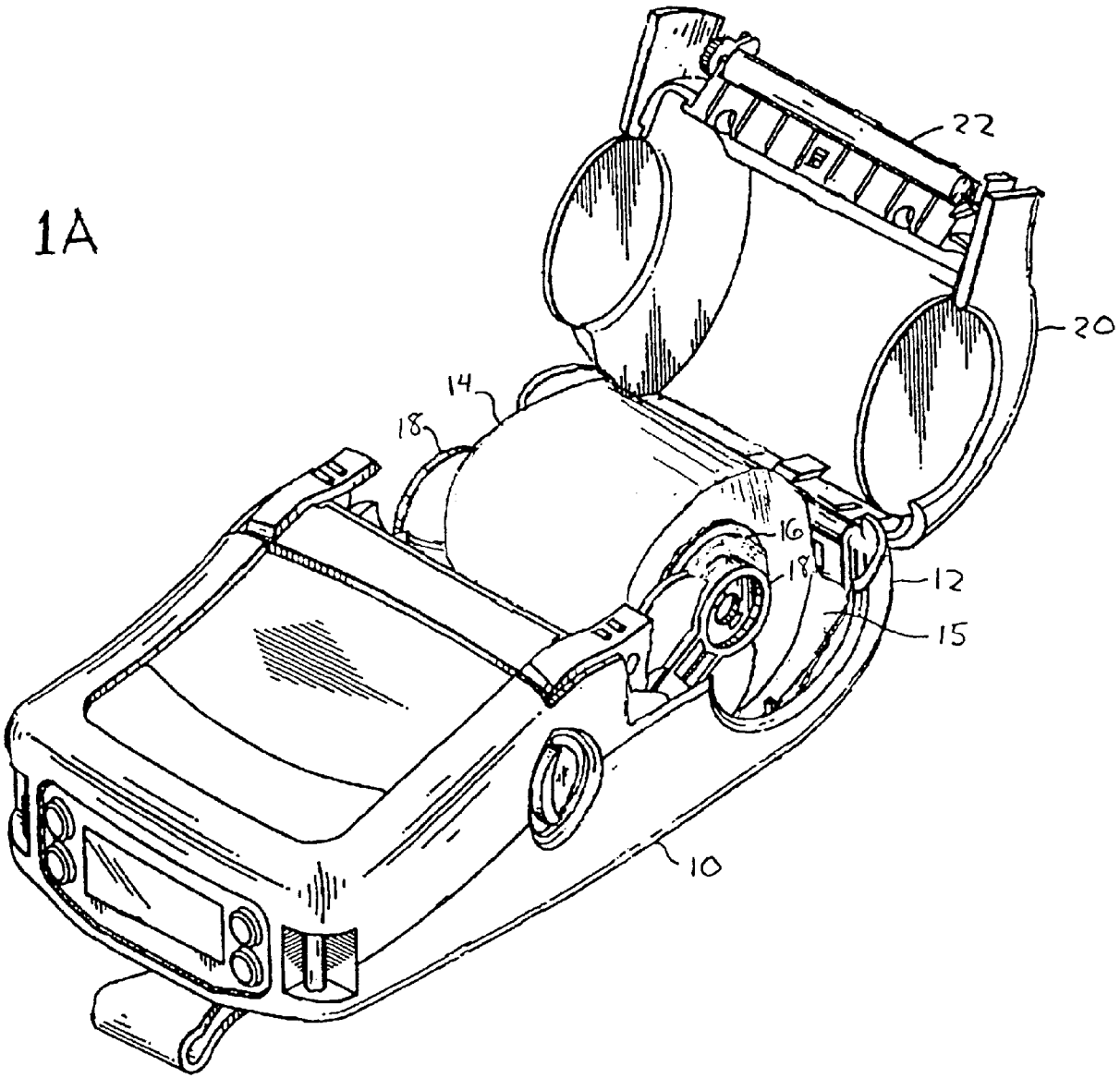
FIG. 1A is the same perspective view as FIG. 1 with a roll of media located between the spindle members.

Referring to FIGS. 1 and 1A, a portable printer 10 is shown having a housing 12 with a roll centering mechanism to enable the media wound upon a roll 14 to be centered in a compartment 15 of the housing with respect to a print head for printing on media from the roll. Media may represent paper, or label stock to provide printing of labels from a paper carrier. The centering mechanism has two spindle members 16 each rotationally mountable on an edge guide arm (member) 18, and a rack and pinion assembly (not shown) located in the printer housing 12 for enabling movement of the spindle members 16 along with their respective edge guide arm 18, in opposite directions with respect to a center position between them. The printer has a thermal print head for printing on media extending from the roll 14, and when a cover 20 of the housing 12 over compartment 15 is closed, such media from the roll is advanced by a motor driven platen 22 across the print head and exits the printer. FIG. 1A shows an example of a roll 14 when loaded in the printer 10 prior to closure of cover 20, which is pivotally mounted about a hinge 21. The housing 12 contains printer electronics for controlling operation of the printer, including the print head and motor driving the platen, as shown for example in U.S. Pat. No. 6,609,844, which is herein incorporated by reference. The centering mechanism and its rack and pinion assembly may be as described in this patent, with or without automatic alignment to roll width, for coupling racks for reciprocal movement. The centering mechanism and rack and pinion assembly may have multiple (e.g., three) pinions or gears coupling racks for reciprocal movement, such as described in U.S. patent application Ser. No. 10/350,970, filed Jan. 23, 2003, published under U.S. Publication No. US2003/0141655, which is also herein incorporated by reference. However, other roll centering mechanisms may also be used which have other assemblies for mounting a roll between two members biased towards each other. The spindle members 16 are urged together by a spring coupled to the rack and pinion assembly, as described in the above incorporated patent and patent application, however such spring may be in the pinion gear, such as described in U.S. Pat. No. 6,607,316, which is also incorporated by reference. The present invention is directed to the improved spindle members 16, which are coupled to the edge guide arms similar to those shown in the incorporated patent, and a printer and method with such improved spindle members. The portable printer is miniature in that it is of a weight and size suitable for being carried or worn by a user, such as on the belt. Examples of such printers include Models QL220, QL320, and QL420 printers sold by Zebra International, Inc. of Vernon Hills, Ill. However, the improved spindle members described herein may be incorporated in roll mounting mechanisms in other printers by modification of their edge guide arm or other means for rotational mounting the roll supporting spindle members.

Figure 2:
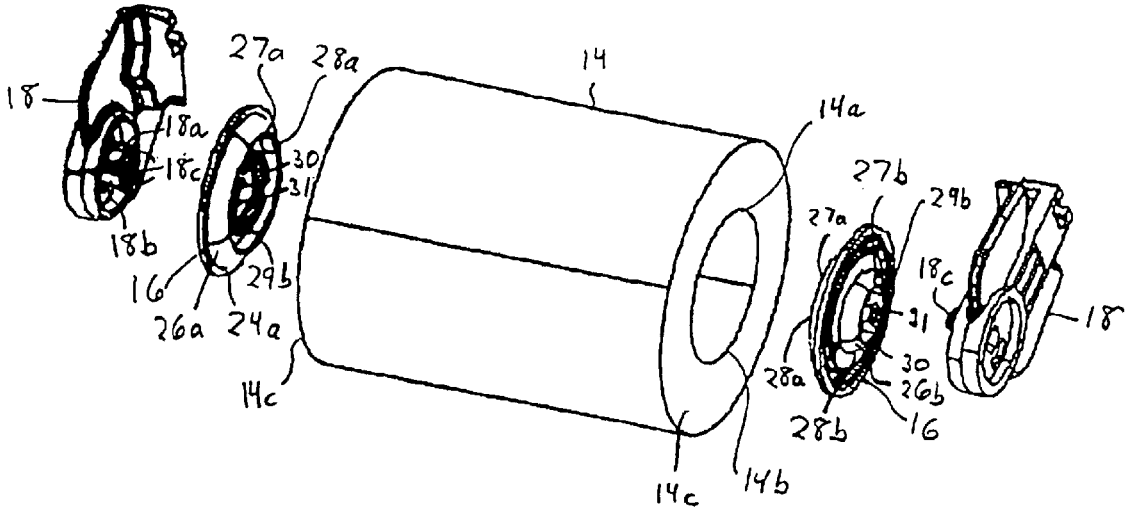
FIG. 2 is an exploded view showing the assembly of the edge guide arms and spindle members of FIGS. 1 and 1A with respect to a media roll.
Figure 3:
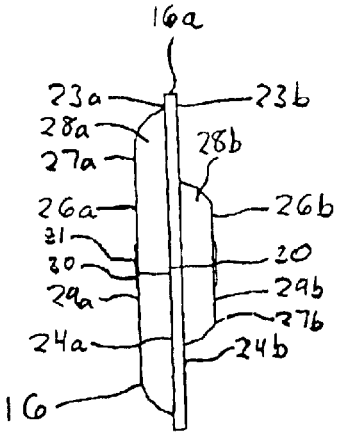
FIG. 3 is a side view of one of the spindle members of FIGS. 1, 1A, and 2.

Referring to FIGS. 2 and 3, each spindle member 16 has a circular or disk shaped member (or body) 16*a* having two sides 23*a* and 23*b*. Sides 23*a* and 23*b* each have a surface 24*a* and 24*b*, respectively, and a centrally disposed conical wall 26*a* and 26*b*, respectively, extending from respective surfaces 24*a* and 24*b* to edge 27*a* and 27*b*, respectively. Walls 26*a* and 26*b* provide outer conical surface 28*a* and 28*b*, respectively, of decreasing diameter from a maximum diameter at its border with respective surface 24*a* and 24*b*. Conical surfaces 28*a* and 28*b* are of different maximum diameters to engage roll cores 14*a* of different diameters, and may have rounded or tapered circular front edge 27*a* and 27*b*, respectively. For example, conical surface 28*a* may be used for mounting 1 and ⅜ inch roll, and conical surface 28*b* may be used for mounting ¾ inch rolls. The conical surfaces may be of other diameters depending on the desired two roll core diameter sizes to engage the spindle members. A cylindrical shaft 30 having an opening 31 there through extends through disk member 16*a* and both sides 23*a* and 23*b* centrally with respect to conical walls 26*a* and 26*b*. The shaft 30 provides a hub for mounting the spindle member 16 on an edge guide arm 18. The front 29*a* and 29*b* of respective conical walls 26*a* and 26*b* is shown open to show the inside of each conical wall 26*a* and 26*b* about the part of shaft 30 extending along respective sides 23*a* and 23*b*. However, the front 29*a* and 29*b* may be closed about shaft 30, such as by a wall extending from respective edges 27*a* and 27*b*, or by providing two post or portions providing the conical surface 28*a* and 28*b*, central circular opening 31 extending through such posts or portions rather than shaft 30, where surfaces 24*a* and 24*b* represent a ring extending outward radially from the base of such posts or portions. For example, each conical surface 28*a* and 28*b* extends about ¼ inch from its respective surface 24*a* and 24*b*. The spindle members 16 may be composed of one piece of molded plastic, or of multiple molded plastic parts integrated together.

Each of the edge guide arms 18 has a three (or other number) of prongs 18*a* along a cylindrical shape to form a shaft 18*b* upon which to mount one of the spindle members 16. To mount one of the spindle members 16 upon its respective edge guide arm 18, the prongs 18*a* are received through opening 31 of shaft 30. The conical surfaces 28*a* and 28*b* are each truncated at their distal end along front 29*a* and 29*b*, respectively, from disk member 16*a* such that the shaft 30 and its opening 31 is of a length enabling mounting on shaft 18*b* of each edge guide arm 18. The end of each prong 18*a* has a latch member 18*c* providing a ledge extending over the end of the shaft 30 when the spindle member 16 is mounted thereon, thereby retaining the spindle member on shaft 18*a* and allowing rotation of the spindle member upon shaft 18*a*. Each spindle member 16 is mounted on its respective edge guide arm 18 such that either side 23*a* or 23*b* of the spindle member faces the edge guide arm 18 and the other side will face the roll when loaded in printer compartment 15. For each of spindle members 18, the side 23*a* or 23*b* to face a roll is selected such that the maximum diameter of conical surfaces of the selected side will frictionally and releasably engage the inner diameter of the end 14*b* of a core 14*a* of a roll 14, such that both spindle members can engage the two opposing ends of roll core and rotate with the roll 14 upon shafts 18*b* of their respective edge guide arms 18. Diameter of shaft 30 is less than the diameter of shaft 18*a* such that the spindle member can rotate upon shaft 18*a*. The edge guide arms 18 may be made of self-lubricating material, such as plastic with Teflon®, to reduce friction when spindle members rotate. To remove each spindle member 16 from its respective edge guide arm 18, the latch members 18*c* are pushed by a user in an inward radial direction to release latch members 18*c* from the end of shaft 30 while pulling the spindle member away from the edge guide arm.

In operation, each of the spindle member 16 is attachable to its respective guide member 18 such that the side 23*a* or 23*b* of each spindle member 16 facing the roll 14 is selected to have a conical surface 28*a* or 28*b* of a diameter for engagement into a core of a roll when loaded in the printer's compartment. The sides of each of the spindle members has a surface 24*a* or 24*b* from which the conical surface of the side extends and the conical surface has a maximum diameter suitable to engage the inner diameter of the end 14*b* of a roll core 14*a* mountable upon the conical surface, such that annular region outside the base of the conical surface at surface 24*a* and 24*b* contacts side edge 14*c* of the roll 14 when such spindle member fully engages the roll core 14*a*. The ability to detach and reverse each spindle member 16 with respect to its respective guide arm 18 thus enables presentation of two different diameter conical surfaces for engaging two different diameter roll core 14*a* in the printer. For purposes of illustration, FIG. 2 illustrates an example where conical surface 27*a* of each of the spindle members 16 faces the roll 14, and reversing each of the spindle members 16 would enable conical surface 27*b* of each of the spindle members to mount onto a roll 14 of a smaller diameter than the roll shown in this figure.

Figure 4:
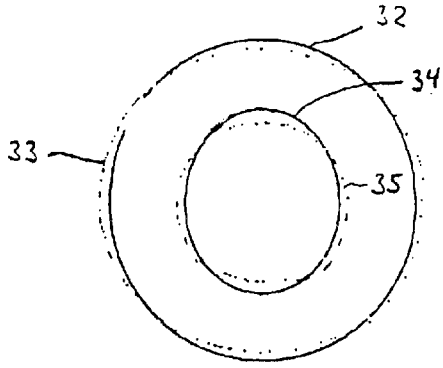
FIG. 4 is an end view of a roll core illustrating a crushed core and uncrushed core upon each of the two different diametered conical surfaces of one of the spindle members.

When the crushed roll is mounted it sometimes will not have a core with a circular cross-sectional shape, rather the cross-sectional shape would be oval. The conical surfaces 28*a* and 28*b* of each spindle member 16 reshapes the ends of a crushed roll core from a oval cross-sectional to a substantial circularly cross-sectional shape when the spindle members are urged (such as by spring force) towards each other by the centering mechanism into the ends of the roll core. If needed, the user may manually provide additional pressure to push the roll core onto the desired conical surface. This is illustrated by FIG. 4 in which line 32 represents the circular end of the core of a crushed roll prior to locating the roll core on a spindle member 16, and dotted line 33 represents the reshaped or circularized end of the same core after being loaded upon conical surface 28*a*. Similarly, line 34 represents the circular end of the core of a crushed roll prior to locating of the roll on a spindle member 16, and dotted line 35 represents the reshaped or circularized end of the same core after being loaded upon conical surface 28*b*.

Although each printer has two identical reversible spindle members 16 for rotationally mounting a roll, a set of multiple different pairs of spindle members 16 maybe provided each pair having sides with conical surfaces for different diameter roll cores. Thus, enabling the printer 10 to be adapted for use with more than two roll core diameters as desired.

Preferably, the surfaces extending from sides 23*a* and 23*b* of the spindle member are conical to enable reshaping of crushed cores. Less preferably, the sides of each spindle member 16 may have two cylindrical protruding portions, walls, or post, of different diameters to provide an outer cylindrical surface, rather than conical surfaces 28*a* and 28*b*, for engaging two different diameter roll cores.

From the foregoing description, it will be apparent that there has been provided a portable printer with improved spindle members for rotationally mounting media rolls of different core diameters. Variations and modifications in the herein described portable printer, spindle members, and method of use, in accordance with the invention will undoubtedly suggest themselves to those skilled in the art. Accordingly, the foregoing description should be taken as illustrative and not in a limiting sense.

What is claimed is:

1. A printer comprising:

a housing having a compartment for a roll of media having a core with a diameter;

a roll positioning means; and two spindle members coupled to said roll positioning means in the compartment, in which each of the spindle members has two sides with different diameter conical surfaces and are reversibly mountable to said roll positioning means to select the side of each of said spindle members having said conical surfaces of the diameter for engaging the diameter of the core of the roll mountable between the spindle members.

2. The printer according to claim 1 wherein roll positioning means comprises two guide members coupled to each other for movement in opposite directions with respect to a position between said guide members, in which each of said two spindle members are rotatably mounted upon a different one of said guide members for engaging ends of a core of the roll when loaded in the compartment.

3. The printer according to claim 1 wherein each of said spindle members has a shaft with an opening extending though said sides of the spindle member centrally disposed with respect to the conical surfaces of the spindle members, and each of said edge guide members has a shaft for removably mounting via said opening of one of said spindle members.

4. The printer according to claim 1 wherein said roll positioning means urges the conical surface of said selected side of each of the spindle members into ends of the core of the roll.

5. The printer according to claim 1 wherein when the core of said roll is crushed or of a non-circular cross-sectional shape, the conical surface of the selected sides of each of the spindle members when located in the core of the roll reshapes the interior diameter of the ends of the core of the roll to a substantially circular cross-sectional shape.

6. The printer according to claim 1 wherein said roll positioning means urges the conical surface of said selected sides of each of the spindle members into the ends of the core of the roll to locate the conical surface in the core.

7. The printer according to claim 1 wherein said sides of each spindle member represents a first side and a second side, said conical surface of said first side is capable of engaging different ones of the roll having a first diameter core, and said second side has a conical surface capable of engaging different ones of the roll of a second diameter core.

8. The printer according to claim 1 wherein roll positioning means comprises a pair of racks and one or more gears, each said racks being coupled to one of said guide members and to each other by said gears to enable each of said guide members to move in opposite directions with respect to a position between the guide members, and each of said guide members has means for removably mounting one of said spindle members.

9. The printer according to claim 1 wherein said spindle members represent two of a plurality of different spindle members each having different sides of different diameter conical surfaces for adapting the printer for using rolls having more than two different core diameters.

10. The printer according to claim 1 wherein the conical surfaces of each of said spindle members is truncated.

11. The printer according to claim 1 wherein said housing is portable.

12. A system for engaging rolls of media having different diameter cores for printing on the media located on the rolls comprising:

a guide member for positioning the media roll; and a spindle member for connecting to said guide member, said spindle member for engaging an end of the roll of media, said spindle member comprising:

a body having first and second sides, in which each of said sides having a surface for engaging different diameter cores sizes; and an opening extending through said body centrally with respect to the surface of each of said sides;

wherein said spindle member is rotatably connectable to said guide via said opening, and wherein said spindle member is capable of connection to said guide in a first position such that said first face of said spindle member faces and engages the roll of media having a first diameter core and is capable of connection to said guide in a second position such that said second face of said spindle member faces and engages a roll of media having a different diameter core.

13. The spindle member according to claim 12 wherein said spindle member is attachable via said opening in a printer to select one of a first of said sides to engage a core of a roll in the printer, or a second of said sides to engage a core of a different diameter core than said first of said sides.

14. The spindle member according to claim 12 wherein said core of the roll has two ends, and said surface of each of said sides is conical to enable the spindle member when inserted in one of said ends of said core to reshape said one of said ends when said one of said ends is oval.

15. A printer for printing on media from a roll of media having a core comprising:

a housing;

two guide members in said housing; and two spindle members each rotatably mounted upon a different one of said guide members for engaging ends of a core of the roll when loaded in the compartment, each of said spindle member having a surface for engaging different diameter core sizes, and a hub for enabling attachment and detachment to one of said guide members in the printer to select a first of two sides to face and engage a core of a roll in the printer, or selecting a second of two sides to face and engage a core of a different diameter core than said first side.

16. The printer according to claim 15 wherein said guide members are spring biased towards each other to urge said spindle members toward each other into the ends of the core of the roll, each of said spindle members has a surface when urged into the ends of the core of the roll that shapes the interior diameter of the ends of the core of a roll to a substantially circularly cross-sectional shape when said roll is crushed.

17. The printer according to claim 15 wherein said surface of each of said spindle member is of a conical shape.

18. The printer according to claim 15 wherein said housing is portable.

19. A printer for printing on media from a roll of media having a core comprising:

a housing with a compartment for a roll of media;

means in said housing comprising two guide members coupled to each other for movement in opposite directions with respect to a position between said guide members;

two spindle members are rotatably mounted upon a different one of said guide members for engaging ends of a core of the roll when loaded in the compartment; and each spindle member comprises a disk with two sides, each of said sides having one of a conical or cylindrical protruding portion of a different diameter, and said disk having a hub enabling attachment and detachment from its respective guide member to select one of said sides having a protruding portion of a diameter to face and engage the core of the roll when loaded in the compartment.

20. The printer according to claim 19 wherein said housing is portable.

21. A method in a printer for rotationally mounting a roll of media having a core comprising the steps of:

providing two roll supporting members rotationally mountable in the printer, in which each of said members has two sides, each side has features for engaging rolls of different diameter cores than the other side of said member; and rotationally mounting each member in the printer in which the side of each member facing said roll has the features for engaging the interior diameter of the core of the roll.

22. The method according to claim 21 wherein said features along each side of said member represents one of conical or cylindrical protruding surfaces.

23. The method according to claim 21 further comprising the steps of:

urging the members of each of the guide members toward each other into the ends of the core of the roll; and providing upon each member a surface which when urged into the ends of the core of the roll shapes the interior diameter of the ends of the core of a roll to a substantially circularly cross-sectional shape when the ends of the roll are oval.

* * * * *

UNITED STATES PATENT AND TRADEMARK OFFICE

CERTIFICATE OF CORRECTION

PATENT NO. : 6,874,958 B1
DATED : April 5, 2005
INVENTOR(S) : Panebianco et al.

It is certified that error appears in the above-identified patent and that said Letters Patent is hereby corrected as shown below:

Title page,
Item [57], ABSTRACT,
Line 4, "tow" should read -- two --.

Signed and Sealed this

Fifth Day of July, 2005

JON W. DUDAS
*Director of the United States Patent and Trademark Office*